US006325694B1

(12) United States Patent
Clever et al.

(10) Patent No.: US 6,325,694 B1
(45) Date of Patent: Dec. 4, 2001

(54) FLEXIBLE JOINT CONSTRUCTION TOY

(76) Inventors: Eric Clever; Ray Lyons, both of P.O. Box 29 Estaugh Ave., Haddonfield, NJ (US) 08033

( * ) Notice: Subject to any disclaimer, the term of this patent is extended or adjusted under 35 U.S.C. 154(b) by 0 days.

(21) Appl. No.: 09/250,737

(22) Filed: Feb. 16, 1999

Related U.S. Application Data

(63) Continuation-in-part of application No. 08/862,948, filed on May 30, 1997.

(60) Provisional application No. 60/074,700, filed on Feb. 13, 1998, and provisional application No. 60/018,771, filed on May 31, 1996.

(51) Int. Cl.[7] ..... A63H 33/10

(52) U.S. Cl. ..... 446/104; 403/165; 403/294; 446/111; 446/122

(58) Field of Search ..... 446/85, 102, 104, 446/113, 111, 117, 120, 122, 128; 403/292, 294, 164–165

(56) References Cited

U.S. PATENT DOCUMENTS 3,698,123 * 10/1972 Heldt .
3,699,709 * 10/1972 Schmidt .
3,994,102 * 11/1976 Johnson et al. ..... 52/2
4,214,403 * 7/1980 Knudsen .
5,928,051 * 7/1999 Krog ..... 446/104

FOREIGN PATENT DOCUMENTS

2646561 * 10/1976 (DE) ..... 446/102

* cited by examiner

*Primary Examiner*—John A. Ricci
(74) *Attorney, Agent, or Firm*—Norman E. Lehrer

(57) ABSTRACT

Disclosed are improvements to a construction system based on genderless connectors. The improvements consist of elements that allow connection at an arbitrary angle in the same plane as a hub assembly. Additionally are disclosed elements that allow for the construction of spheres from planar circular hubs.

3 Claims, 9 Drawing Sheets

FLEXIBLE JOINT CONSTRUCTION TOY

CROSS-REFERENCE TO RELATED APPLICATIONS

This application claims the benefit of U.S. Provisional patent application Ser. No. 60/074,700, filed Feb. 13,1998. This application is also a continuation-in-part of U.S. patent application Ser. No. 08/862,948, filed May 30, 1997, which claims the benefit of U.S. Provisional patent application Ser. No. 60/018,771, filed May 31, 1996.

BACKGROUND OF THE INVENTION

1. Field of the Invention

This invention relates to construction toy systems. More particularly, it relates to both hub and rod construction toy systems based on hermaphroditic and identical (genderless) connectors, and to building block systems also based on genderless connectors. In many cases the genderless connectors are integral to the parts being connected. And the genderless connectors greatly extend the range of applications for this invention.

2. Prior Art

This is a crowded art with much activity in the construction toy system part of it, with many U.S. patents, referred to by number below, known to the inventors which have some pertinence. U.S. Pat. No. 1,113,371 discloses an original rod and hub construction toy system with wooden hubs and rods and with the rod inserted into a hole in the hub and held there by friction and compression (interference fit). U.S. Pat. No. 1,707,691 discloses a hub and rod construction toy system with a hub of stamped metal and wooden rods with slit ends. The connection is formed by inserting the metal hub into the rod-end slit.

A great many construction toy systems allow identical elements to be interconnected but with only a few exceptions noted below the actual connections are not genderless. Instead, the male and female connecting elements are placed on opposite ends of the block or hub. In any event, we found no construction system that allowed genderless connection between non-identical elements, e.g., between hub and rod. U.S. Pat. No. 3,626,632 discloses a typical building block system that allows identical blocks to be interconnected by means of a male element on one side and female elements on three other sides. U.S. Pat. No. 2,800,743 discloses a nearly genderless building block system. But in this system, when genderless connections are made, the elements are no longer aligned and regular figures can not be constructed.

U.S. Pat. No. 2,633,662 discloses a construction toy system with genderless interconnection for hubs connected orthogonally. But hub and rod connections in the same plane are effected with rods that connect across the face of the hubs and do not form a genderless connection. U.S. Pat. No. 4,758,196 discloses a hub and rod construction toy system with genderless rod-rod connections but without any way of directly connecting the hubs.

Various concepts from the construction and other industries have been adapted to construction toy systems. U.S. Pat. No. 3,648,404 discloses a hub and rod construction system designed to be used with hollow rods. The construction toy system disclosed in U.S. Pat. Nos. 4,078,328 and 5,049,105 uses a similar connection system. U.S. Pat. No. 3,891,335 discloses a hub and rod and panel snap together construction system. The hub and rod construction toy system disclosed in U.S. Pat. Nos. 5,061,219, 5,137,486 and 5,199,919 uses a retaining clip similar to the one disclosed in U.S. Pat. No. 3,891,335. U.S. Pat. No. 5,137,486 does disclose a genderless hub-hub connection for orthogonally connecting hubs. However, the means of connecting the hubs is not the same means as connecting rods to hubs.

Other mechanical connectors include Pat. No. 4,280,339, which discloses a torque transfer device for flexible shaft couplings. Each shaft has an extended portion with forked ends defining teeth. The teeth are inserted orthogonally to each other. U.S. Pat. No. 3,800,556 discloses a power shaft coupling including a coupling mechanism having elongate square bars defining extensions. These extensions may be mutually inserted in orthogonal positional relationship. Pat. No. 2,577,508 is a universal coupling with bifurcated tongues that mate. Pat. No. 2,832,943 is a detachable coupling in which the male and female members are not identical but do have an orthogonal insert relationship. U.S. Pat. No. 3,224,222 is a universal joint with yoke members including cross-pintles for connecting the yoke members together.

Hermaphroditic connectors have been used in the electronic connector industry. The invention disclosed herein grew out of our prior electronic connector inventions. See Clever and Lyons U.S. Pat. No. 5,183,409 and continuation-in-part application Ser. No. 08/011,994.

Other presently known U.S. Patents of interest are: U.S. Pat. Nos. 3,516,043; 3,070,769; 2,690,542; 3,011,143; 4,199,208; 3,634,811; 2,996,026; 3,070,769; 2,475,046; 2,470,282; 1,865,300; 2,577,508; 607,607; 3,552,145; 1,171,380; 2,740,271; 4,172,369; 2,460,231; 534,732, and 2,389,115. It is believed, however, that the present invention is patentably distinct from the teachings of any of the above-cited patents.

SUMMARY OF THE INVENTION

Described herein are improvements to the construction toy systems disclosed in our co-pending U.S. patent application Ser. No. 08/862,948 filed May 30, 1997, the subject matter of which is incorporated herein by reference. Our copending application describes toy systems all of whose parts directly interconnect by means of genderless connectors. The improvements include: partial hubs that when connected to a regular hub (as disclosed in the related application) create partial spheres, and other partial hubs that can be hinged together so as to create any-connection-angle hubs.

By the use of these genderless connectors plus the disclosed improvements, a very wide range of very different and independent toy systems can be designed that freely inter-connect. In fact, the invention disclosed in the related application with the addition of the improvements disclosed in this application allows for the creation of a near universal construction toy system—one that allows for free interconnection across a wide range of construction toy types: hub-and-rod, beam-and-beam, blocks, and geodesics all in a range of sizes that makes them appropriate for various age groups from toddler (very large and easy to grasp) to adult (miniature, precision) with all the pieces from all the sizes and types interconnecting.

BRIEF DESCRIPTION OF THE FIGURES

For the purpose of illustrating the invention, there are shown in the accompanying drawings forms which are presently preferred; it being understood that the invention is not intended to be limited to the precise arrangements and instrumentalities shown.

DESCRIPTION OF THE PREFERRED EMBODIMENTS

Disclosed are additional elements to the inventions disclosed in the related application referred to above. These disclosures include various any-connection-angle-hubs.

Figures 1A, 1B, 1C:
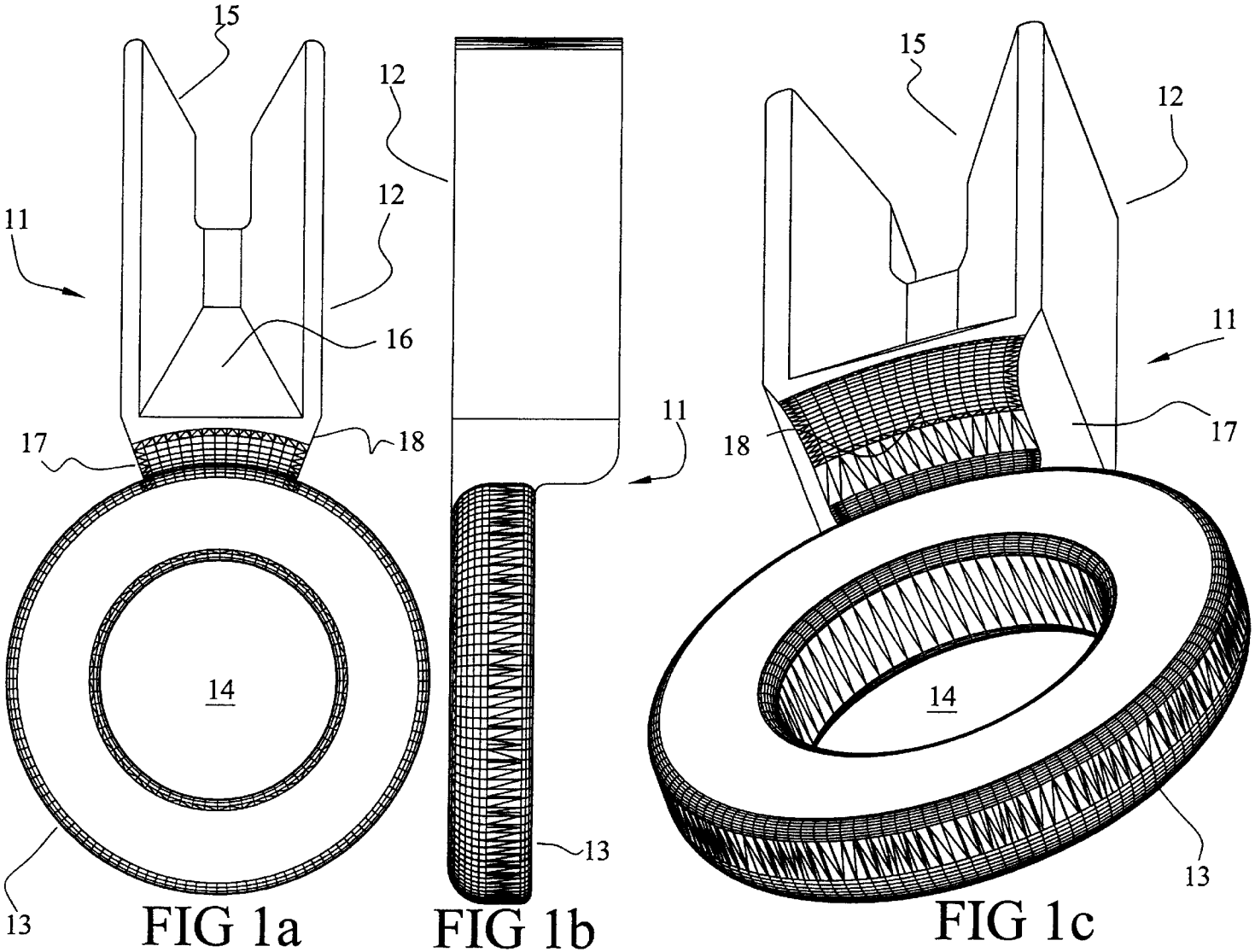
FIGS. 1*a* and 1*b* show in plan view and FIG. 1*c* shows in perspective view a partial hub comprised of a washer and a connector. The washer is half the material thickness of a standard hub. The connector is the full thickness of a standard hub and is attached in such a way that the bottom of the connector is on the same plane as the bottom of the washer.
Figure 3:
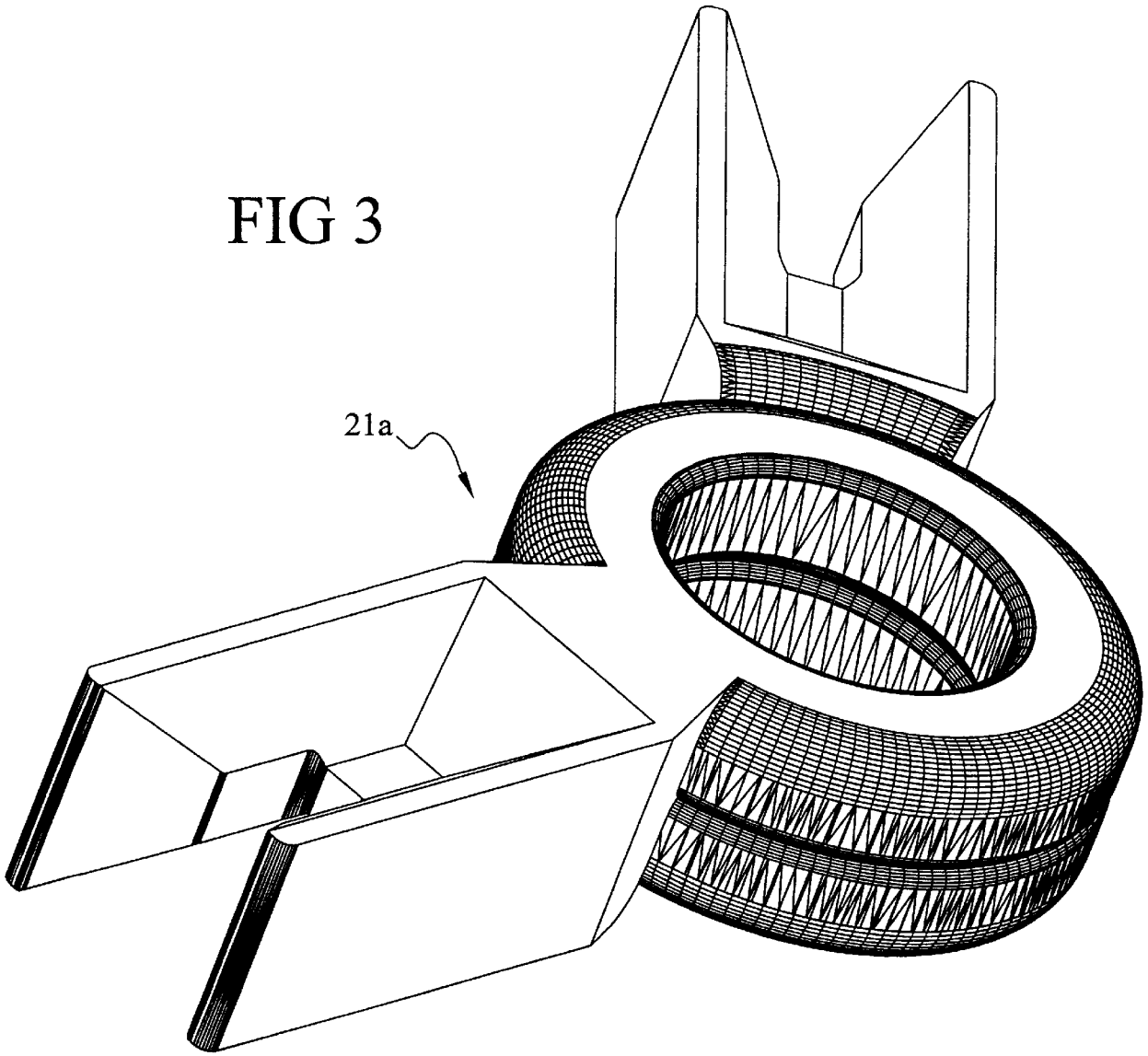
FIG. 3 is a view similar to FIG. 2*a* but without a rivet—shown only for clarity.

The important features of partial hubs are as follows. As shown in FIG. 1, washer 13 is half the material thickness of a standard hub while connector portion 12 is full thickness. The connector portion is placed on the washer with its bottom in the same plane as the bottom of the washer. This configuration allows two of them to be placed together in such a way that the washers form the central core of a hub and the center of the material thickness of the two connectors are aligned just as they would be on a standard hub. When placed in this configuration, the configuration shown in FIG. 3, on a rivet, such as rivet 51 of FIG. 5, restraining bosses 53*a* and 53*b* maintain two partial hubs as shown in FIG. 3 while partial-hubs are free to rotate relative to each other on bearing surface of the rivet. It must be noted that the connector is not carried straight back to the washer—a small angle must be cut out in order to allow two partial hubs to rotate to within 45° of each other.

The rivets are actually special purpose rods and can be used as such and are furnished with connectors at each end. As can be seen in the various figures, its connectors are similar to connectors on partial and half hubs—complete with chamfered entry, slot, and web. As can be seen by inspecting FIG. 5, web 58 actually holds the rivets two vertical halves 59*a* and 59*b* together. But very importantly, these elements—chamfered entries, slots 56*a* and 56*b*, the web, plus lead-in chamfers 54*a* and 54*b*-together form a spring with enough give to allow the hole in the partial-hub-washer to be forced over the restraining bosses.

Figure 4:
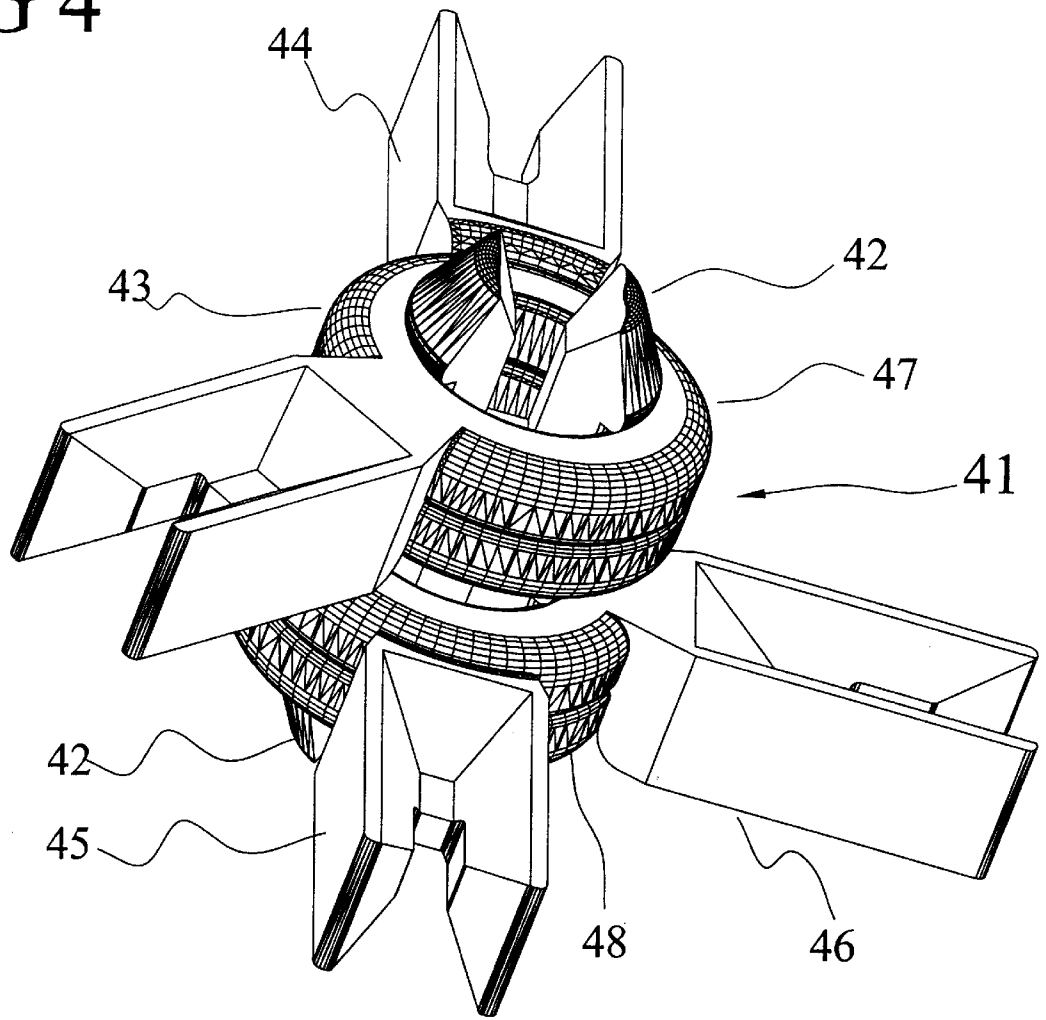
FIG. 4 is a view similar to FIG. 2*a* but with two any-angle-hubs—one assembled on each end of a rivet.
Figures 5, 5A, 5B, 5C:
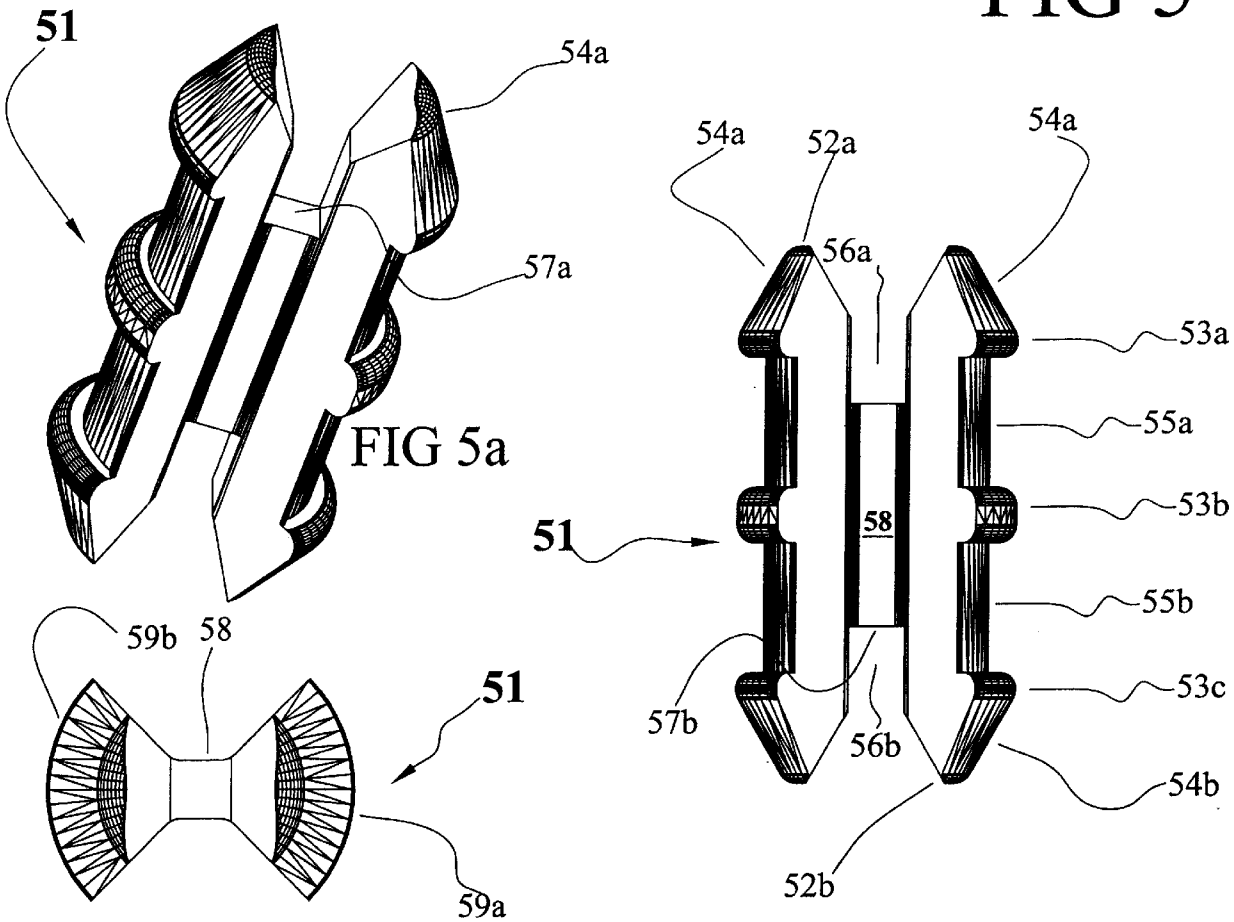
FIGS. 5*a*, 5*b* and 5*c* shows a rivet in perspective, end and plan views, respectively.

As can be seen in FIGS. 4 and 5, a rivet is equipped with locations to form two any-connection-angle-hubs. If only one location is used, the connector part of the rivet on the other half can be used to attach an assembly to the connector on a rod or a hub—or on another rivet for that matter.

Figure 6:
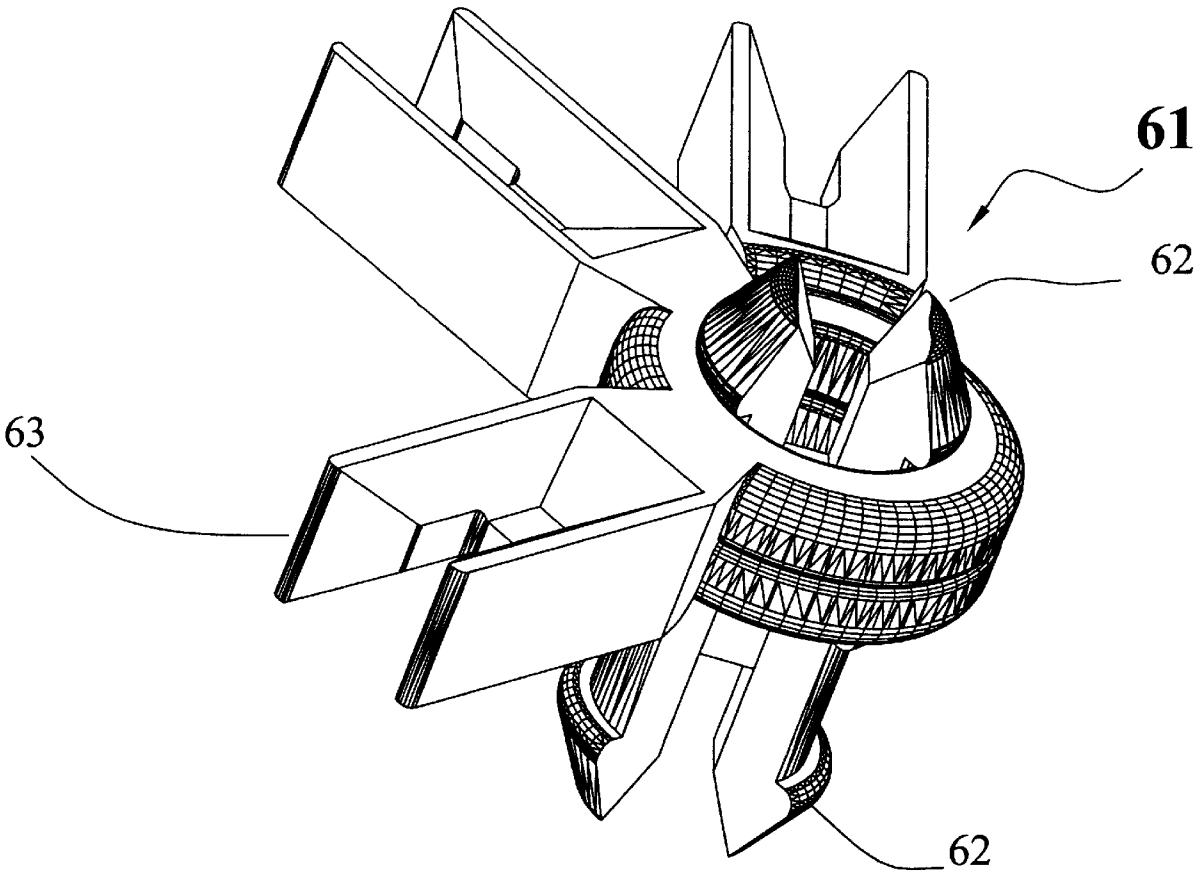
FIG. 6 shows an embodiment similar to that shown in FIG. 4. In this case the top partial hub has two connectors. The connectors are placed 90° from each other.
Figure 7B:
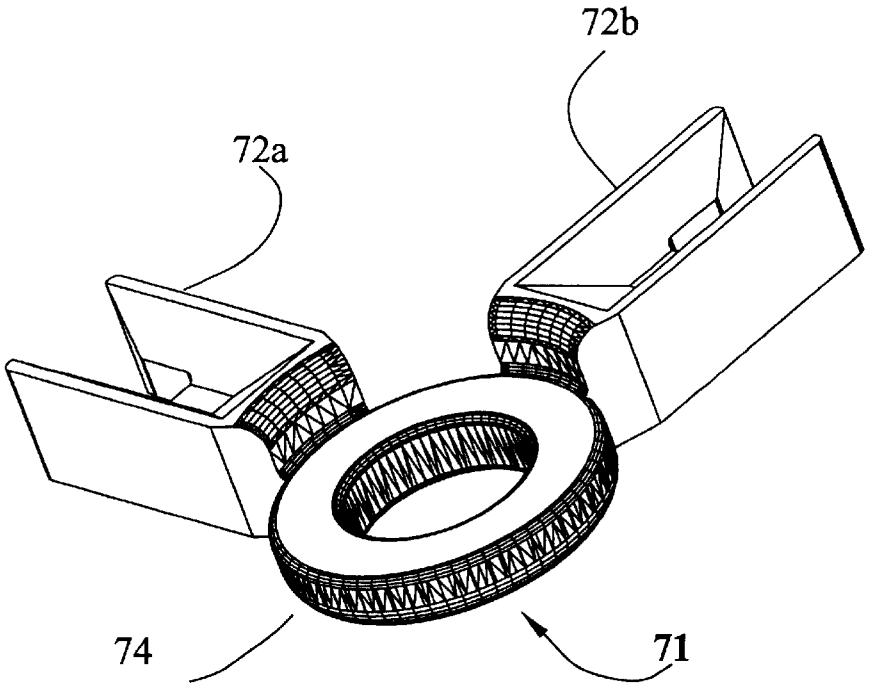
FIGS. 7*a* and 7*b* show partial hubs in plan and perspective views.
Figure 7A:
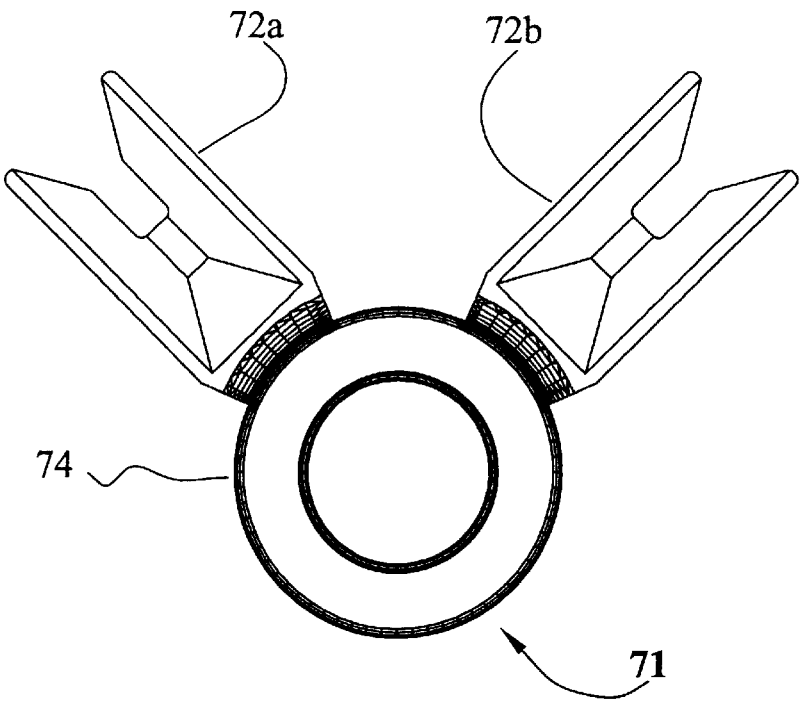
Figure 8A:
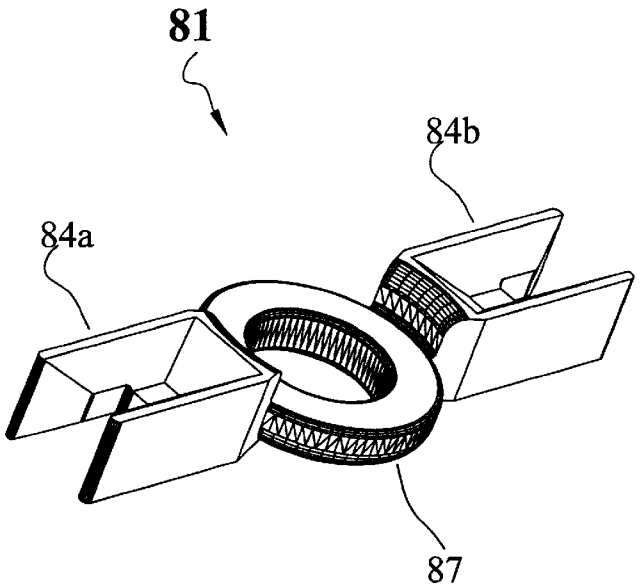
FIGS. 8*a*, 8*b* and 8*c* show, in perspective view, different multi-connector partial hubs.
Figure 8B:
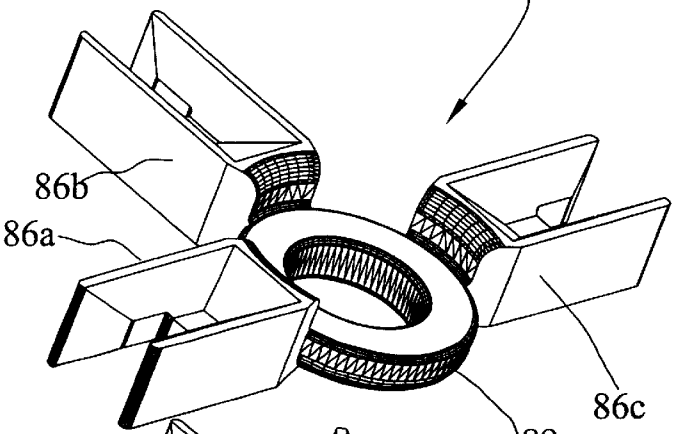
Figure 8C:
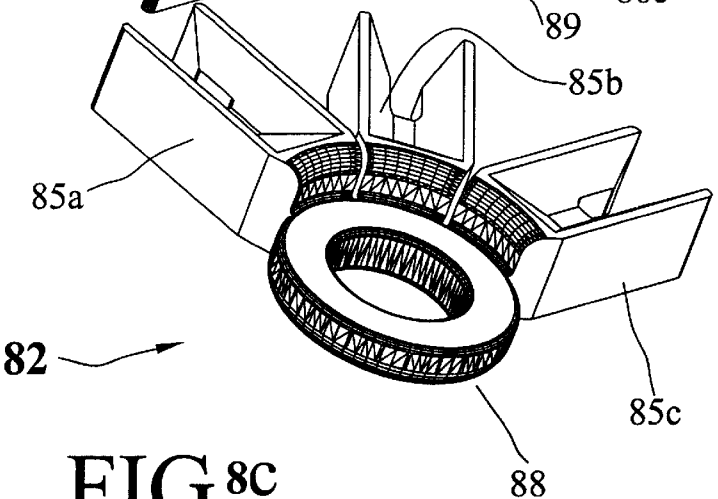

As can be seen in FIGS. 6, 7, and 8, partial hubs can be provided with more than one connector. Partial hub 81 of FIG. 8 is effectively also a rod. Its web-face to web-face distance can be the same as that of a basic rod in a construction toy system. If two partial hub type is are used to make an any-connection-angle-hub, 135° of relative rotation is possible. If two partial hub type 2*s* are used to make an any-connection-angle-hub, 215° of relative rotation is possible. Obviously, various combinations of multiple connector hubs result in various degrees of freedom.

Figure 9B:
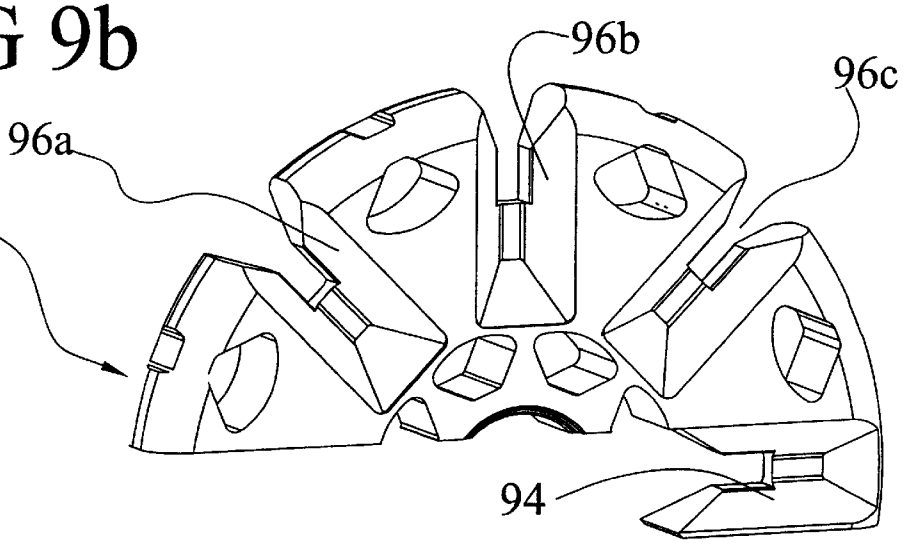
FIGS. 9*a* and 9*b* show, in perspective view, partial (½) hubs suitable for constructing partial spheres.
Figure 9A:
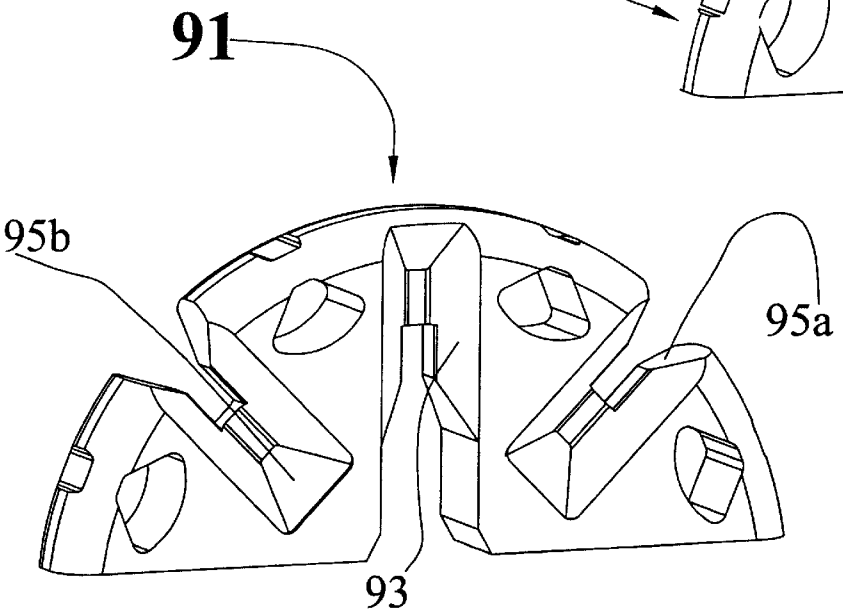

The embodiments of the invention shown in FIG. 9 are used to construct spheres or partial spheres. In the case of half hub 91 (a type 1 half hub), eight of them can be connected, using their inverted connectors, around a regular hub. The resulting construction resembles a sphere with connections available at 45° relative to the plane of the regular hub at intervals of 45°. While in the case of half hub 92 (a type 2 half hub) two such can be connected to a regular hub to form a partial sphere with connections available at 45° and 90° relative to the plane of the regular hub. Also, one type 2 half hub can be combined with six type 1 half hubs to provide many connections available at 45° relative to the plane of the regular hub plus one connection at 90°.

DETAILED DESCRIPTION OF THE FIGURES

Partial hub 11 of FIG. 1 consists of a genderless connector 12 (as disclosed in the related application) joined to a washer 13 by connecting region 18. Genderless connector 12 consists of (in addition to the parts disclosed in the related applications) a lead-in chamfer 15 and reinforcing backfill 16. When two such genderless connectors are fully mated (webfaces touch) the chamfer of one does not quite reach the backfill of the other. Angle-cut 17 in connecting region 18 allows connectors to be spaced within 45° of each other—as can be seen in FIG. 8 with partial-hub 2. Washer 13 has a round center hole 14, which typically would have the same diameter as a standard hub in a hub-and-rod construction system. Further, the distance from the center of the hole to webface 19 would be exactly ½ the webface to webface length of a standard #1 rod.

Figures 2A, 2B:
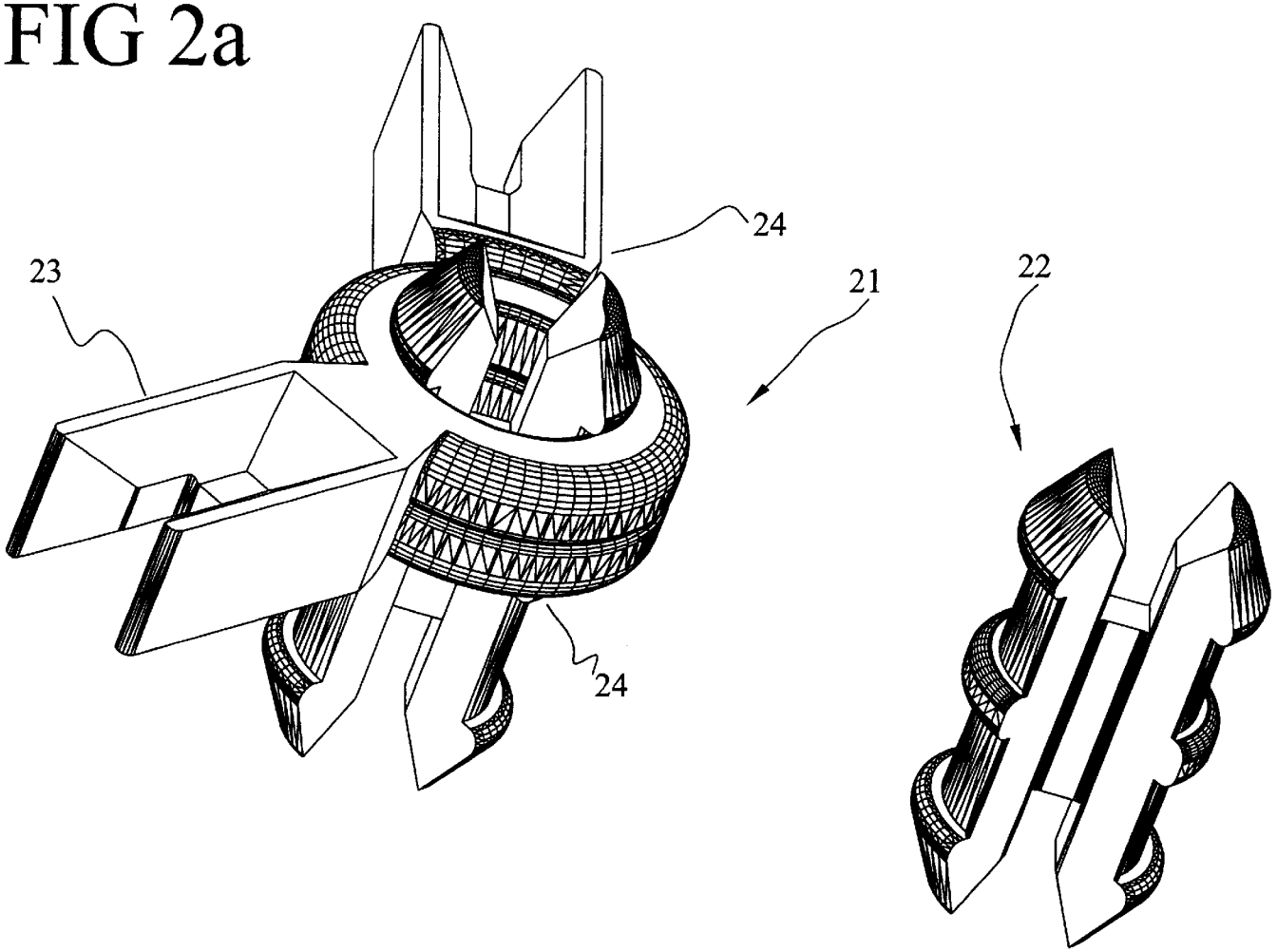
FIG. 2*a* shows, in perspective view, an any-connection-angle-hub assembled from two partial hubs and a rivet. The partial hubs are free to rotate on the rivet. For clarity the rivet is also shown separately in perspective in FIG. 2*b;*

FIG. 2 shows an any-connection-angle-hub assembly 21 consisting of partial-hub a 23 and partial hub b 24. They are assembled on a rivet 23.

FIG. 3 shows 21*a*, assembly 21 of FIG. 2 but without a rivet—the assembly is shown only for clarity.

FIG. 4 shows two any-connection-angle-hubs 47 and 48 assembled on a rivet 42. The top any-connection-angle-hub 47 is composed of partial-hubs 43 and 44. The bottom any-connection-angle-hub 48 is composed of partial-hubs 45 and 46. While it would be possible to construct a rivet that could hold only one any-connection-angle-hub, a rivet that is also a rod with connectors on both ends will naturally form a spring as mentioned above.

In FIG. 5 we show a rivet 51 in plan, end, and perspective views. The rivet is comprised of two connectors 52*a* and 52*b,* which are contiguous on the same axis with no intervening rod body. Restraining bosses 53*a*, 53*b* and 53*c* are partial toroids (toroids with two 90° cuts 90° apart) placed with their major planes perpendicular to the major axis of the rivet. They are placed one regular hub thickness apart—two partial hubs such as 91 can be placed between each pair of bosses. Lead-in-chamfers 54*a* and 54*b* ease rivet-partial hub insertion. Because the rivet has no intervening rod-body inserted between its connectors, web 58 holds vertical halves 59*a* and 59*b* together, which arrangement contributes to the necessary spring-like features of the rivet's operation. Partial-hubs rotate on bearing surfaces 55*a* and 55*b*. Slots 56*a* and 56*b* add to the spring action.

In FIG. 7 we show a multiple-connector partial-hub 71 with connectors 72 and 73 at 90° from each other relative to the center of the washer 74. Except for the second connector 73 this partial-hub is identical to partial hub 11. In FIG. 8 we show three additional partial-hubs. Partial-hub 81 has two connectors 84*a* and 84*b* 180° apart on washer 87. As mentioned above, the partial-hub is also a rod. Partial-hub 82 has three connectors 85*a*, 85*b* and 85*c* spaced 45° apart on washer 88. Partial-hub 83 has three connectors 86*a*, 86*b* and 86*c* spaced 90° apart on washer 89.

In FIG. 9 we show a different kind of partial-hub. Partial-hubs 91 and 92 are used to construct partial spheres. Partial-hub 91 is a regular hub cut perpendicular to its major plane such that three consecutive connectors are left. The middle connector 93 is inverted such that it points to where the center of the regular hub was. The remaining two connectors 95*a* and 95*b* are unchanged. The inverted connector is used, when constructing a partial sphere, to connect to a regular hub. Up to eight such partial hubs can be connected around a regular hub forming a sphere-like assembly with connections available at 45° relative to the plane of the regular hub at intervals of 45°. Partial-hub 92 is a regular hub cut perpendicular to its major plane such that four consecutive connectors are left. In the fourth position connector 94 is inverted such that it points to where the center of the regular hub was. The remaining three connectors 96*a*, 96*b* and 96*c* are unchanged. The inverted connector is used, when constructing a partial sphere, to connect to a regular hub.

The present invention may be embodied in other specific forms without departing from the spirit or essential attributes thereof and accordingly reference should be made to the appended claims rather than to the foregoing specification as indicating the scope of the invention.

We claim:

1. A flexible joint construction toy comprised of:

an axially extending rivet, said rivet including a bearing surface and first and second spaced apart restraining bosses, at least said first boss being located adjacent an end of said rivet and including a chamfered edge;

at least two hub assemblies, each hub assembly including a substantially toroid-shaped washer and a connector extending outwardly from the outer circumference of said washer, the thickness of said washer in the axial direction being approximately one-half the thickness of said connector;

the diameter of the end of said first boss being less than the diameter of the opening in each of said washers whereby each of said hub assemblies is adapted to be forced over said chamfered edge of said first boss so that said washer fits around said bearing surface between said first and second bosses and wherein said washer is free to rotate about said rivet, the length of said bearing surface between said first and second bosses being substantially equal to the combined thickness of said two washers so that axial movement of said washers is substantially prevented by said first and second bosses.

2. A flexible joint construction toy as claimed in claim 1 wherein each of said washers of said two hub assemblies is adapted to fit around said bearing surface between said first and second bosses simultaneously with one of said washers overlying the other of said washers but with said connectors being in substantial planar alignment with each other.

3. A flexible joint construction toy as claimed in claim 2 wherein said connectors are capable of rotation about said rivet.

* * * * *